United States Patent [19]

Strong

[11] Patent Number: 4,846,214

[45] Date of Patent: Jul. 11, 1989

[54] FLUID ADDITIVE INJECTOR

[76] Inventor: Thomas F. Strong, 8733 Magnolia, Suite 100, Santee, Calif. 92071

[21] Appl. No.: 244,285

[22] Filed: Sep. 15, 1988

Related U.S. Application Data

[63] Continuation-in-part of Ser. No. 123,195, Nov. 19, 1987, which is a continuation of Ser. No. 937,404, Dec. 3, 1986, abandoned.

[51] Int. Cl.[4] ..... B01F 3/12

[52] U.S. Cl. ..... 137/268; 137/805.5; 137/199; 422/261

[58] Field of Search ..... 137/205.5, 268, 199, 137/197; 422/261, 281, 282, 283

[56] References Cited

U.S. PATENT DOCUMENTS

| | | | |
|---|---|---|---|
| 846,100 | 3/1907 | Estep | 137/205.5 X |
| 1,079,721 | 11/1913 | Pungs | 137/205.5 |
| 1,082,141 | 12/1913 | Sites | 137/205.5 X |
| 2,544,476 | 3/1951 | Venning | 137/199 X |
| 2,881,781 | 4/1959 | Tavernese | 137/205.5 |
| 2,908,282 | 10/1959 | Maisch | 137/199 |
| 3,194,444 | 7/1965 | Hubert | 137/205.5 |
| 3,941,211 | 3/1976 | Grutter | 137/205.5 X |
| 3,943,960 | 3/1976 | Syrenne | 137/268 |
| 4,333,493 | 6/1982 | Beiswenger | 137/268 |

*Primary Examiner*—Alan Cohan

*Attorney, Agent, or Firm*—Frank D. Gilliam

[57] ABSTRACT

A system which combines an additive storage vessel and mixing section containing pressure and suction taps off of a main transfer tube. This allows controlled blending of additive into a fluid stream without external energy or controls. The tank is shaped to allow a stratified layer of fluid to slowly displace the additive. Displacement energy is supplied by a positive pressure tap facing into the flow converting dynamic pressure of fluid flow into increased static pressure and a reduced pressure tap created by facing with the stream flow. Trickle tubes connect the taps to opposite ends of the additive charge, which is slowly pushed and pulled into the fluid stream. Rate of additive supply can be controlled by restrictors, tap orientation or tank orientation. An air relief valve is provided to allow escape of non-pressurized air from tank.

14 Claims, 2 Drawing Sheets

FLUID ADDITIVE INJECTOR

This is a continuation in part of pending application Ser. No. 07/123,195 filed Nov. 19, 1987 pending, which is a continuation in part of Ser. No. 06/937,404 filed on Dec. 3, 1986 and now abandoned.

FIELD OF THE INVENTION

This invention relates to storage tanks and tank supply systems. It also relates more specifically to water borne insecticide and fertilizer delivery or water soluble additive systems.

BACKGROUND OF THE INVENTION

A variety of means have been used to blend soluble additives into fluid streams. These include positive displacement metering pumps, venturi tubes, pumps and control valves, gravity feed drainage and batch mixing. Specifically in the area of water soluble additives for garden type of application, a venturi type of suction device attached to a jar at the end of a garden hose is commonly used. Attached to the fluid suction point typically is a tube to the bottom of the jar, which slowly drains the additive from the jar.

Several problems occur with this type of garden additive system. The rate of addition is not constant since the height of additive (hydraulic head) is changing as additive is withdrawn. Blending and mixing efficiency also varies as fluid is withdrawn and pressure at the suction point changes. The configuration also requires the use of a garden hose even if a sprinkler system is in place and operating. The size of the jar is limited since it must be held for long times, sometimes necessitating multiple fillings of the jar for a single application. Leakage around fittings can also contaminate operator and equipment. Residue in the jar must also be flushed and cleaned out after each use to prevent encrustation. Line pressure surges may also present a safety hazard to someone holding a glass jar. At all times, the operation must be manned and monitored in order to distribute the blended discharge and end the application when the jar is empty.

Other types of additive systems (pumps, valves, etc.) are generally too cumbersome, complex, unreliable or costly for the simple gardening task. What has been sought is a simple, reliable means of supplying a fixed amount of insecticide or liquid fertilizer in a timed sprinkler system or garden hose application.

SUMMARY OF THE INVENTION

The principal and secondary objects of the invention are:

- to provide an injection system capable of unattended operating;
- to provide an injection system capable of even distribution of a fixed quantity of additive;
- to provide an injection system which can easily vary rate and quantity of addition;
- to provide an injection system which operates without an external source of power;
- to provide an injection system which is selfcleaning; and These and other objects are achieved by providing a cylindrical additive storage vessel with a transfer tube extending between a fluid inlet and outlet located near the top of the vessel. A fluid pressure tap with at least a portion of a fluid receiving distal end surface facing into the stream in the transfer tube. The other end of the tap is connected to a trickle tube for diverting a small portion of the fluid from the transfer tube to a location adjacent to the bottom of the vessel. A second identical tap, but with a dispensing distal end with at least a portion facing in the direction of the liquid flow in the transfer tube, is connected to a trickle tube which draws a corresponding small portion of the additive into the main fluid stream adjacent to the top of the vessel. The fluid displacement of diluted liquid additive maintains a relatively constant gravity head with the sum of positive and negative pressures created by the taps thereby maintaining a uniform flow pressure. This constant pressure rate allows for the dispensing of a known quantity of liquid additive material over a given time period. The pressure rate can be easily adjusted by altering the position of the distal end openings of the taps relative to the main fluid stream, adding restrictions or orientation of the vessel which alters the gravity head. Because the metering of liquid additives can be timed, glass storage vessels (for viewing the remaining liquid additive) can be replaced with a container constructed of a safer and more suitable material. Upon completion of the metering of the liquid additive from the vessel liquid from the main fluid stream (generally water) has completely replaced the liquid additive, eliminating the requirement for a separate cleaning or flushing of the vessel.

The positioning of the distal end of the trickle tube adjacent to the bottom of the container provides a continual agitation of the main fluid and the liquid additive providing a blending thereof, because the liquid additive is primarily a liquid fertilizer or insecticide and, therefore, generally heavier or more dense than the main stream fluid, a gradual dilution of the liquid additive occurs between the bottom and the top of the vessel increasing the length of the metering time of the additive liquid. The distal end of the upper most trickle tube is positioned as close to the top of the container as practical. This positioning allows the vessel to be substantially filled with additive liquid and prevents any insoluble or other slowly dissolvable chunks or bits of additive material or contaminants from the main fluid from reaching the distal end of top trickle tube which could disrupt or slow the expected metering of the liquid additive into the main liquid stream. In essence any solids will remain on or near the bottom of the vessel and can be discarded at a latter time.

The vessel includes a first stand pipe communicating with the interior of the vessel at the bottom thereof and a second stand pipe communicating with the interior of the vessel at the top thereof. Although these stand pipes can be located at any position on the top or bottom surface, generally the stand pipes will be centrally located on the top and bottom. A centrally positioned top stand pipe allows for maximum filling of the vessel with additive liquid therethrough and a centrally positioned bottom stand pipe allow for any solids to be deposited therein for easy removal at a latter time and if vessel flushing is required this can accomplished through the stand pipes.

The top end of the upper stand pipe includes an air relief valve, two embodiments shown and described herein to remove any air trapped in the vessel which is replaced with fluid stream. In both embodiments the air relief valve includes a spring biased closure valve member. The spring biases the valve member in a valve open position. The valve remains biased open until the level of liquid additive and main fluid elevate the spring biased valve member against a valve seat closing off the air relief valve and thereby preventing any liquid flow from the vessel out of the stand pipe. The location of the air relief valve as well as the distal end of the upper trickle tube allows for the vessel to be filled to substantially its maximum capacity.

The materials of construction may, for example, and, not by way of limitation, be plastic or the like to minimize maintenance and corrosion. Fluid connections can be pipe (allowing fixed installation in a garden sprinkling system) or hose threads (allowing portable installations).

BRIEF DESCRIPTION OF THE DRAWING FIGURES

DESCRIPTION OF THE PREFERRED EMBODIMENT OF THE INVENTION

Figure 1:
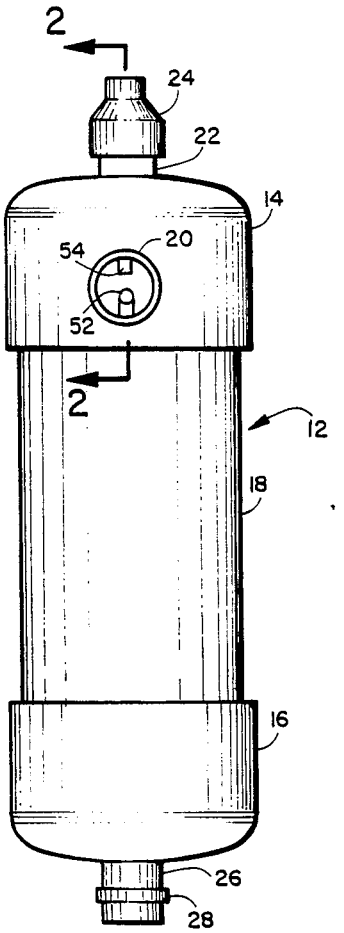
FIG. 1 shows a side view of the additive injector of the invention.

FIG. 1 shows a side view of the additive injector 10. The main body is made from a section of cylindrical duct 12, has a domed top cap 14, and a domed bottom cap 16 attached either by threads or cementing to form a closed cylindrical vessel 18. The vessel may contain fertilizer, insecticide or any other liquid additive. The fluid which the additive is to be blended into, enters the vessel at inlet pipe fitting 20 which is attached to duct 12. The vessel is filled with the liquid additive through stand pipe 22 which is threaded and sealed with air relief valve 24. A stand pipe 26 is included in the bottom cap 16 for drainage of the vessel 18, and is normally sealed with drain cap 28. Drain cap 28 may also be removed for access or drainage. In an alternate use, a water soluble but solid additive is stored in the vessel. Top air relief valve 24 would be removed to fill the vessel with a solid granular additive. The fluid would slowly enter the vessel and dissolve the solid additive. The additive/fluid mixture would then be drawn out of the vessel to be blended into the main fluid stream. Plastic construction materials are preferred as they are generally compatible with a variety of liquid and solid additives, and the fluid, typically water. Pressure rating of the construction materials must be consistent with intended fluid pressures and flows.

Referring now to FIGS. 2, 3A, 3B and 3C, FIG. 2 is a cross-sectional front view of the top portion of the vessel. Cylindrical duct 12 forms the side walls of the vessel with the top cap 14 forming the top. Stand pipe 22 is sealed by an air relief valve 24 or 24A. The relief valve 24 comprises a valve member 30 which has a valve sealing member 32 at one end thereof with an extended outer edge surface 25 which cooperates with a sealing surface 34 within relief valve housing 36. The sealing surface includes a centrally positioned aperture 38 through which an elongated member 40 that is centrally attached at one end to the sealing member 32 extends and a plurality of vent apertures 41. The distal end 43 of the elongated member is bulbous and larger in diameter than the aperture 38 and the elongated member 40. The valve member is free to translate relative to aperture 38. A coil spring 42 is positioned around the elongated member and between the upper surface of the sealing member 32 and the adjacent sealing surface 34. The coil spring 42 biases the sealing member away from the sealing surface. When the liquid in the vessel raises against the bottom of the sealing member, the valve sealing member translates against the spring bias causing the edge surface 25 to seal of vent apertures 41. The now compressed coil spring is confined within the central area of the sealing member adjacent to the ridge. The relief valve **24*a*, includes a fixedly positioned sealing surface 34*a*. A resilient valve member 32*a*, constructed from rubber, soft plastic or the like, is translatable relative to sealing surface 34*a* and engages the sealing surface 34*a* when the liquid in the vessel rises against the bottom thereof sealing off the venting of relief valve 24*a*. In this embodiment of the relief valve the spring 42*a* is held in place by a friction connection to the upper stem portion 45 of resilient valve member 32*a* and stem 47 of resilient valve member 32*a*. The translation of the resilient valve member is guided by the inner surface of the relief valve housing and held in place by a resilient ring washer 35. The ring washer 35 has outwardly extending ears or tabs 49 for removably securing the ring washer to the inside of housing 36 and inwardly extending ears or tabs 51 for containing resilient valve member 32*a* in place. The space between ears or tabs 51 provide air passages for venting. Inlet fitting 20 is aligned with an outlet fitting 44 and both are attached to duct 12. A transfer tube 46 connected the inlet fitting 20 with the outlet fitting 44. A pair of pressure taps 48 and 50 are attached to the transfer tube 46. The taps include fluid ports which have an angled face. The angle of the face can range from 30 degrees to 90 degrees. The preferred angle is approximately 45 degrees. The first tap 48 is oriented with first fluid port 52 facing into the fluid flow stream (direction of fluid flow stream shown by the arrow in FIG. 2). The second pressure tap 50 is oriented with the second port 54 in the transfer tube facing towards the outlet fitting 44. The pressure taps shown are bulkhead unions protruding into the fluid stream with fluid ports cut at an angle to the flow, creating forward or aft facing surfaces. The pressure taps 48 and 50 may also be pilot tubes with apertures directly facing forward or aft. The taps 48 and 50 may be threaded or otherwise attached to allow rotation of fluid ports 52 and 54 relative to fluid flow. The sealing of the taps in the transfer tube may be with threads, thread sealant or a gasket (not shown for clarity). The orientation of the pressure taps create a positive pressure at 52 by converting the dynamic fluid flowing energy into a static pressure. Port 54 creates a slight reduction in fluid pressure by creating fluid velocity around the tap, drawing fluid from the upper end of the vessel 18** into the stream.

Connecting trickle tubes 56 and 58 are attached to the pressure taps and respectively terminate adjacent to bottom cap 16 and top cap 14. Additive vessel can be filled up to the top transfer tubewith additive material and stored until use. If use is to be immediate, additive vessel can be filled up to near the top of suction connecting trickle tube 58. As fluid flows past pressure tap 48, a small amount of main fluid is forced into connecting trickle tube 56. Upon discharge into the bottom of the vessel near bottom cap 16, this small amount of main fluid under pressure is mixed with and displaces diluted additive towards top cap 14. Air relief valves 24 or 24*a* allow for the escape of fluid displaced vessel air as the level of liquid raises above the level of the open end of trickle tube 58. As fluid flows past pressure tap 50 a small amount of diluted liquid additive (or dissolved solid additive) is drawn (at reduced pressure) into connecting trickle tube 58. If solid additive is used, trickle tube ports must be small enough or screened to preclude entry of any solid particles in suspension.

The rate of diluted additive withdrawal may be controlled by pressure tap face orientation or addition of restrictions in the pressure taps. The rate may also be adjusted by rotating the vessel to reduce the gravity head of the additive/fluid mixture in the vessel.

Figure 4:
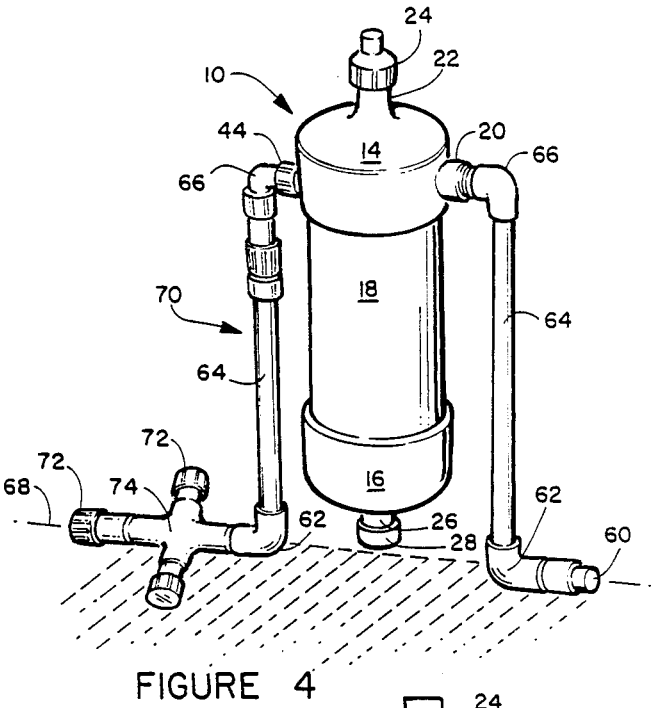
FIG. 4 shows a perspective view of a piping installation of the additive injector of the invention.
Figure 3A:
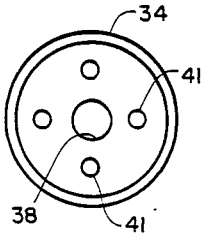
FIG. 3A is a plane view of the sealing disk of the first embodiment of the air release valve.
Figure 2:
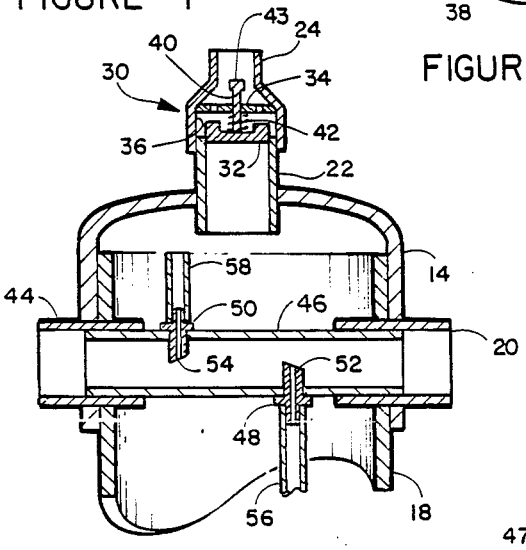
FIG. 2 is a cross-sectional front view of the top portion of the vessel.

FIG. 4 shows a perspective view of a piping installation of injector 10. The piping is typical of a garden sprinkler system. Water supply piping 60 is attached to a supply elbow 62, straight riser 64 and inlet elbow 66 which is attached to inlet fitting 20. The covered portion of the piping extends below ground level 68 to connect with the sprinkler pipes. At the outlet fitting 44 a similar piping arrangement including an outlet elbow 66, straight discharge pipe section 64 and return elbow 62 reconnect to the supply piping 72. In a typical garden application, supply piping 72 would branch off to multiple sprinklers. In an above ground installation, the cross connector 74 provides a stable footing for the injector 10.

Figure 5:
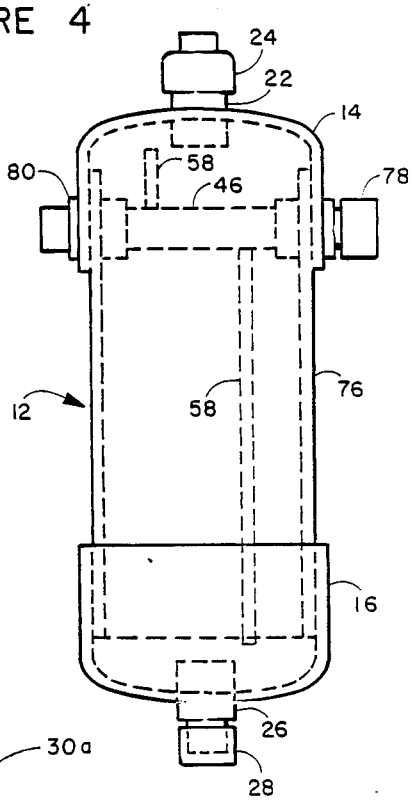
FIG. 5 shows a front view of an alternate portable injector of the invention.
Figure 3B:
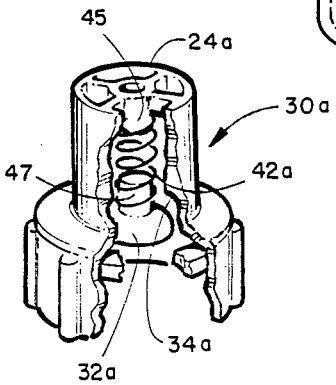
FIG. 3B is a perspective showing of a second embodiment of the air release valve.
Figure 3C:
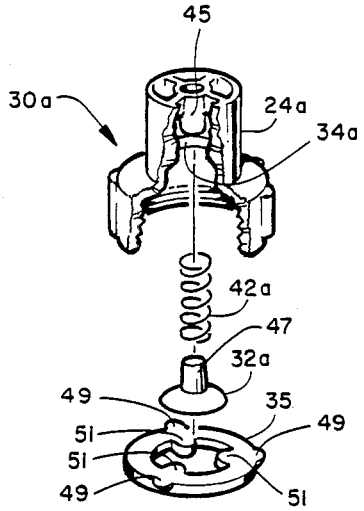
FIG. 3C is an exploded detailed showing of FIG. 3B.

FIG. 5 shows a front view of an alternate portable injector design. The additive vessel is composed of a shorter cylindrical duct 76 similar to cylindrical duct 12, but smaller to reduce weight which may be held. Top cap 14 and bottom cap 16 can be identical. Other internal components (shown dotted for clarity) can also be identical, except that the length of pressure and suction connecting trickle tubes 56 and 58 must be consistent with new shorter duct 76. Hose inlet 78 is the type that an be threadly connect to a garden hose bib water supply. Hose outlet 80 similarly adapts to a nozzle or hose segment. Placed on the top cap 14 is the air relief valve 24, 24*a* (for details see FIGS. 2 , 3*a*, 3*b* and 3*c*). The valve is threaded, allowing for removal from and the use of fill stand pipe 22. Valves 32 or 32*a* are biased open towards bottom cap 16 by coil springs 42 or 42*a* and will close under the presence of the liquid against the lower surface of sealing surface 34 or 34*a* when the vessel is full preventing spillage (see FIGS. 2 and 3). Stand pipe 26 and drain cap 28 and similar to the previous configuration.

Although this invention has been described in its preferred and alternate embodiments, it is clear that other embodiments and modifications can be devised by those skilled in the art without the exercise of inventive faculty and within the spirit of the invention as well as the scope of the appended claims.

What is claimed is:

1. An additive injection system for controlled addition of a liquid additive to a moving fluid stream comprising:

a cylindrical vessel for containing said liquid additive having a closed domed top and bottom surface and a horizontally aligned tubular inlet and outlet positioned near the domed top thereof;

a transfer tube interconnecting said inlet and outlet, a first trickle tube extending from the interior through the top surface of said tubular transfer tube and terminating at a location adjacent to said domed top;

a second trickle tube extending from the interior through the bottom surface of said transfer tub and terminating at a location adjacent to said domed bottom surface;

a means for connecting said first and second trickle tube to said transfer tube in a sealed relationship therewith;

a first stand pipe extending from the domed top surface the hollow center of which communicates with the interior of said vessel; and a normally biased open air relief valve positioned within said hollow center of said stand pipe intermediate the ends thereof, said air relief valve comprises a valve assembly, a sealing surface having apertures therethrough and a coil spring, said valve assembly comprises a valve sealing member, which is freely translatable within said air relief valve and maintained in operable position by a locating means whereby air in said vessel displaced during the filling of said vessel with moving fluid can vent out of said stand pipe through said air valve normally biased open by said coil spring positioned between said sealing surface and said valve sealing member and when the combined liquid and fluid level reaches the bottom of said valve sealing member the force of said liquid and fluid will elevate said valve sealing member against the bias of said coil spring in contact with said sealing surface thereby substantially preventing the escape of the combined liquid and fluid from said vessel during use.

2. The invention as defined in claim 1 wherein the ends of said trickle tubes within said transfer tube include a pressure tap having an angled surface, the angled surface of the pressure tap of said first trickle tube faces into the direction of the flow of fluid through said transfer tube and the angled surface of said second trickle tube faces in the direction of the flow of fluid through said transfer tube.

3. The invention as defined in claim 1 wherein said valve sealing member includes an elongated member which extends through a central aperture in the sealing surface has a bulbous distal end surface of a diameter greater than said aperture for maintaining said elongated member in position between said valve sealing member and said sealing surface.

4. The invention as defined in claim 1 wherein said valve sealing member is disk shaped.

5. The invention as defined in claim 1 wherein said sealing member is resilient.

6. The invention as defined in claim 2 wherein the angle of said angled surface of said taps in from 30 degrees to 60 degrees.

7. The invention as defined in claim 2 wherein the angle of said angled surface of said taps in substantially 45 degrees.

8. The invention as defined in claim 1 additionally comprising a second stand pipe extending downwardly from the domed bottom surface, the hollow center of which communicates with the interior of said vessel, a selectively removable cap means is provided for sealing the distal end of said second stand pipe when the additive injection system is ready of use and for opening the distal end of said stand pipe when the additive system is not in use for draining the interior of said vessel.

9. The invention as defined in claim 2 wherein the angled surfaces of said taps are rotatively positional relative to the direction of liquid flow to control the flow of liquid into said second trickle tube and out of said first trickle tube.

10. The invention as defined in claim 2 wherein said taps extend substantially to the longitudinal center of said transfer tube.

11. The invention as defined in claim 2 wherein said taps are threadedly connected to said transfer tube and said trickle tubes form a friction fit over the ends of said taps opposite the angled ends and form a continuation thereof.

12. The invention as defined in claim 1 wherein said sealing surface includes a plurality of vent apertures therethrough.

13. The invention as defined in claim 1 wherein said locating means comprises a resilient keeper ring, said keeper ring includes outwardly extending tabs for removably securing said resilient keeper ring to said air relief valve and inwardly extending tabs for maintaining said sealing member in an operable position.

14. The invention as defined in claim 1 wherein said coil spring is connected to one end to said air relief valve and at its other end to said valve sealing member.

* * * * *